US005493824A

United States Patent [19]

Webster et al.

[11] Patent Number: 5,493,824

[45] Date of Patent: Feb. 27, 1996

[54] ROTATABLY MOUNTED SKYLIGHT HAVING REFLECTORS

[76] Inventors: Lee R. Webster, 7 Shoreview Cir., Indialantic, Fla. 32903; Robert H. Richardson, Rte. 1, Box 12A, Hayesville, N.C. 28904

[21] Appl. No.: 38,002

[22] Filed: Mar. 29, 1993

[51] Int. Cl.[6] ..... F04B 7/18

[52] U.S. Cl. ..... 52/200; 250/203.4; 362/35

[58] Field of Search ..... 52/200, 220; 362/35, 362/150; 136/246, 251; 250/203.4, 239; 126/570, 573, 600, 623, 704

[56] References Cited

U.S. PATENT DOCUMENTS

| | | | |
|---|---|---|---|
| 4,114,186 | 9/1978 | Dominguez | 362/35 |
| 4,349,245 | 9/1982 | Kliman | 126/623 |
| 4,883,340 | 11/1989 | Dominguez | 250/203.4 |
| 5,062,247 | 11/1991 | Dittmer | 52/200 |
| 5,099,622 | 3/1992 | Sutton | 52/200 |

*Primary Examiner*—Carl D. Friedman
*Assistant Examiner*—Christopher Todd Kent
*Attorney, Agent, or Firm*—Michael Drew

[57] ABSTRACT

A housing (20) has an opening for receiving sunlight (54). The opening is covered with an ultraviolet-deflecting lens (50). The housing (20) contains reflectors (80, 82, 84) which direct sunlight (54) through a conduit (91) to a diffuser (98). The housing (20) rests upon and is rotatable with respect to an annular base (30). A horizontal sensor arrangement (66, 67, 68) controls rotational movement of the housing (20) with respect to the base (30) to maintain optimum horizontal alignment of the reflectors (80, 82, 84) with respect to the sun. A vertical sensor arrangement (63, 64, 65) causes vertical angular movement of the reflectors (80, 82, 84) to maintain optimum vertical alignment of the reflectors (80, 82, 84) with respect to the sun. The light conduit (91) contains an infrared-deflecting lens (92) to filter out infrared radiation. A dead air space (96) placed in the light conduit (91) prevents heat transfer as light is transmitted along the conduit (91).

11 Claims, 5 Drawing Sheets

A=20°
A=40°
A=80°
A=80°
B=70°
B=50°
B=10°
B=10°
C=35°
C=25°
C=5°
C=0°
I=35°
I=25°
I=5°
I=10°
R=35°
R=25°
R=5°
R=10°
12
14
20
54
61
80
82
84
91

ROTATABLY MOUNTED SKYLIGHT HAVING REFLECTORS

TECHNICAL FIELD OF THE INVENTION

The present invention relates to skylights, and more particularly to a skylight which reflects light through a conduit and which automatically maintains an optimum angle of reflection between the reflecting surfaces of the skylight and incident sunlight.

BACKGROUND OF THE INVENTION

Sunlight is useful for lighting interior spaces of buildings. However, a problem in attempting to use sunlight for this purpose is that as the earth revolves the sun cannot be maintained in an optimum position for lighting the interior space. Thus, it can be appreciated that it would be desirable to have a means for utilizing sunlight to light interior spaces of a building at a given location throughout the path that the sun travels with respect to the earth.

SUMMARY OF THE INVENTION

It is an object of the invention to provide a means for utilizing sunlight to light an interior space of a building.

It is also an object of the invention to provide a means for utilizing sunlight to light an interior space of a building by reflecting sunlight through a conduit into the interior space.

It is an additional object of the invention to provide a means for utilizing sunlight to light an interior space of a building by reflecting sunlight through a conduit into the interior space while automatically maintaining an optimum angle of reflection with the sun.

According to a preferred embodiment of the invention, a housing has an opening for receiving sunlight. The opening is covered with an ultraviolet deflecting lens. The housing contains reflectors which direct sunlight through a conduit to a diffuser. The housing rests upon and is rotatable with respect to an annular base. A sensor causes rotational movement of the housing with respect to the base to maintain optimum horizontal alignment of reflectors with respect to the sun. A sensor causes vertical angular movement of the reflectors to maintain optimum vertical alignment of the reflectors with respect to the sun. The light conduit may also contain an infrared-deflecting lens to filter out infrared light. A dead air space may be placed in the light conduit to prevent heat transfer as light is transmitted along the conduit.

DETAILED DESCRIPTION OF PREFERRED EMBODIMENTS OF THE INVENTION

Figure 1:
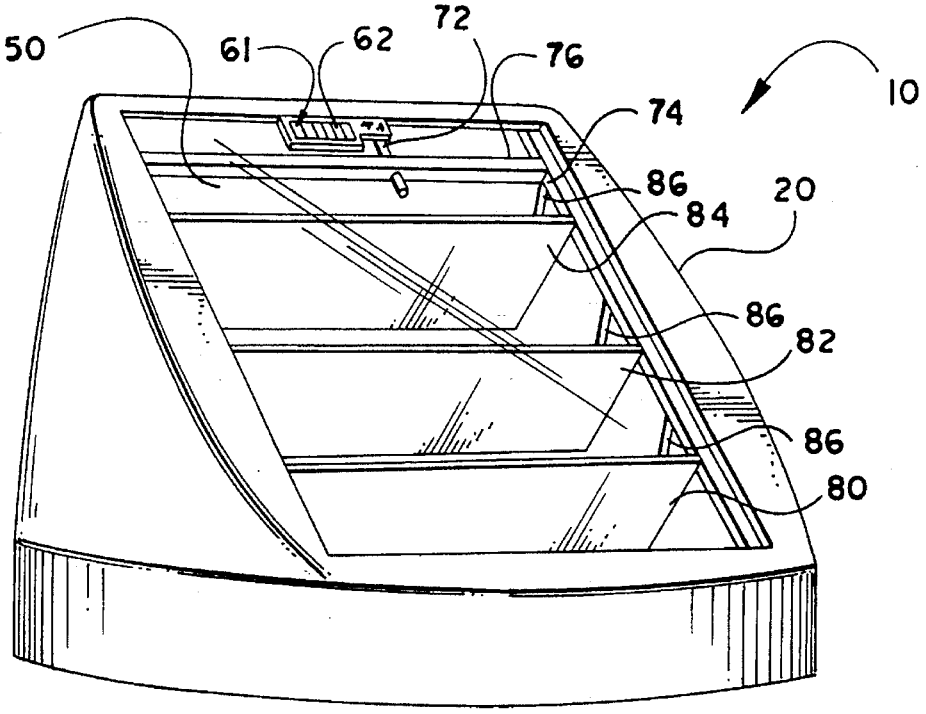
FIG. 1 is an isometric illustration of a skylight according to a preferred embodiment of the invention.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to refer to like features.

According to a preferred embodiment of the invention which will be discussed below, a skylight reflects sunlight through a conduit to a diffuser. The skylight contains reflectors which are caused to automatically maintain an optimum angle of reflection between the sun and the reflectors as the sun travels its daily path. Optimum alignment between the sun and the opening of the housing is maintained horizontally by a sensor which causes the housing to rotate about an annular base as the sun moves horizontally.

Referring first to FIG. 1, therein is shown an isometric illustration of a skylight 10 according to a preferred embodiment of the invention. From this view can be seen the housing 20 which fits over and rotates about an annular base, which cannot be seen in this view. Through the opening in the front of the housing 20 can be seen the reflectors 80, 82, 84 which reflect light downward through the skylight 10. An ultraviolet-deflecting lens 50 fits over the open of the housing 20. Also from the view of FIG. 1 can be seen the photovoltaic-sensor panel 61 whose photovoltaic cells 62 provide power for operating the skylight 10 and whose sensors cause the reflectors 80, 82, 84 and photovoltaic-sensor panel 61 to pivot in vertical angles, and cause the housing 20 to rotate with respect to the base. Through the opening of the housing 20 can also be seen features which will be described in greater detail below, such as the motor shaft 72, stationary rack 74, movable rack 76, and hinges 86 which facilitate pivoting of the reflectors 80, 82, 84.

Figure 2:
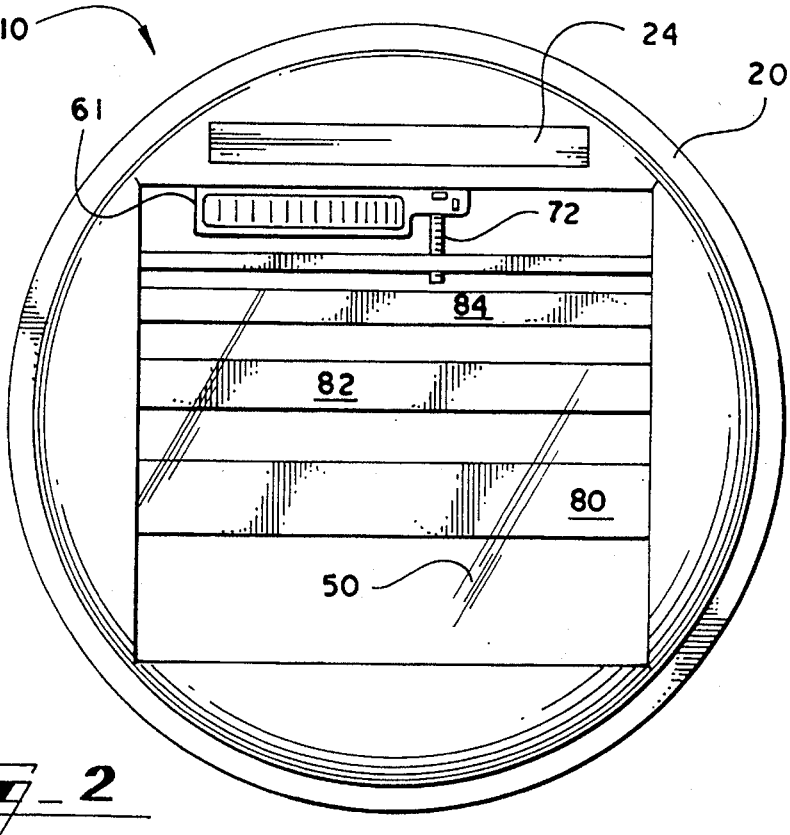
FIG. 2 is a top plan view of the invention of FIG. 1.

Referring now to the top plan view of FIG. 2, therein can be seen through the opening of the housing 20 the reflectors 80, 82, 84, in a rearward-slanting position, and the photovoltaic cell-sensor panel 61, the shaft 72 used in adjusting the angle of inclination of the reflectors 80, 82, 82 and photovoltaic cell-sensor panel 61. The vent cover 24 over the vent which allows warm air to exit the skylight 10 is seen along the rear of the housing 20.

Figure 3:
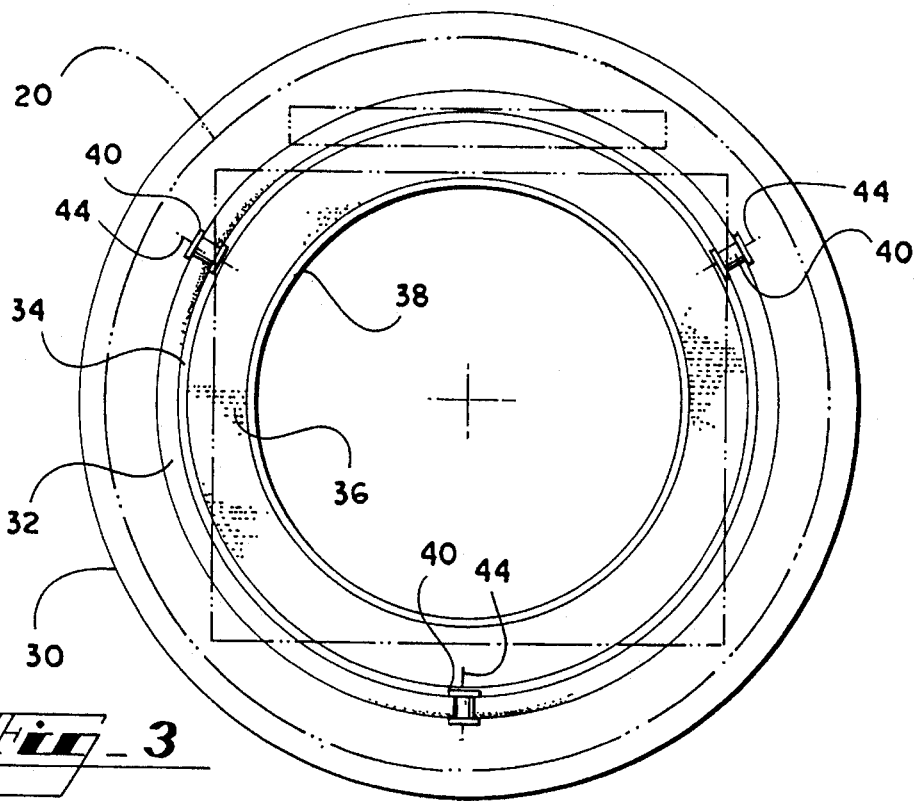
FIG. 3 is a top plan view of the base of the invention of FIG. 1.

Referring now to FIG. 3, the annular base 30 upon which the housing 20 rests and rotates is shown in plan view. Also shogun with the base 30 are rollers 40 and axles 44 which support the housing 20 upon the base 30. The rollers 40 rest and travel upon the raised track (or lip) 32. Protruding from the inside surface of the track 32 is an annular ridge or ring 34 which serves as a part of a mechanism for locking the housing 20 to the base 30 while allowing the housing 20 to remain rotatable with respect to the base 30. This feature will be explained in greater detail below. Ballast 36 helps the base 30 maintain position. The center of the base 30 forms an opening for passage of reflected sunlight. The inner edge 38 of the base is designed to abut the light conduit which will direct light from the housing to the diffuser (discussed below).

Figure 4:
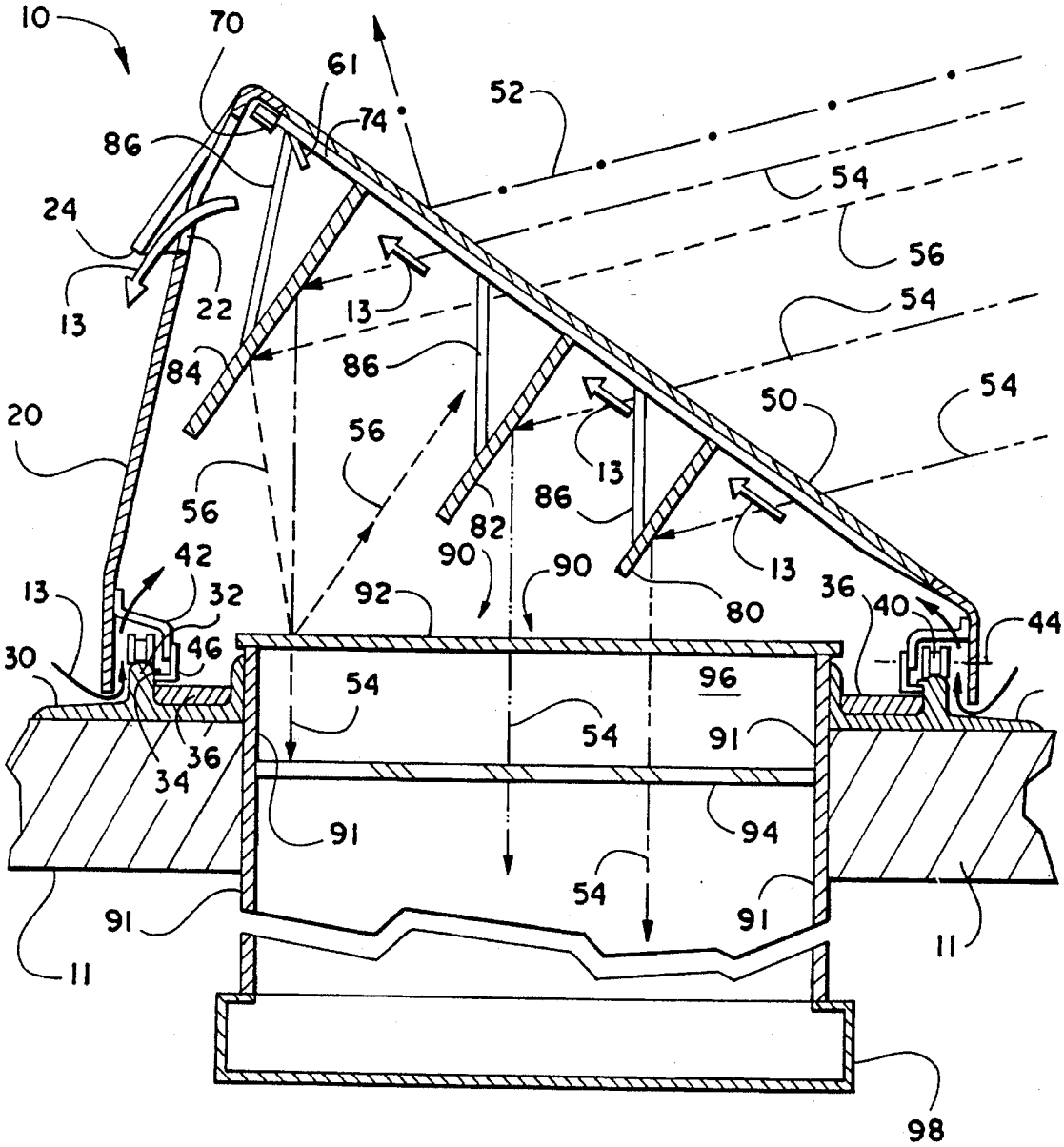
FIG. 4 is a sectional illustration of the invention of FIG. 1.

Referring now to FIG. 4, many significant features of the skylight 10 can be clearly seen. The skylight 10 is shown installed through the roof 11 of a building. The features of the skylight 10 are designed to reflect visible light 54 through to a space to be lighted while prohibiting the passage of ultraviolet radiation 52 and infrared radiation 56. As previously mentioned, an ultraviolet-deflecting lens 50 fits over the opening of the housing 20 to filter out ultraviolet electromagnetic radiation 52 inherent in sunlight. The skylight 10 automatically tracks the movement of the sun throughout its daily trajectory to maintain optimum reflection of sunlight through the skylight 10. As can be seen from the isometric illustration of FIG. 1 as well as the sectional view of FIG. 4, the housing 20 has a generally right-angular pyramid shape. The housing is open at the bottom and has a covered 24 vent 22 at the top of the rear surface. Venting allows the air to flow through the housing 20 from the open bottom up through the vent 22 as illustrated by the arrows 13 shown. Warmer air rises and exits through the vent 22, helping to keep the temperature in the housing 20 lowered. The housing 20 rests and rotates about the base 30 described above. A lip 32 extending upwardly from the base 30 provides a circular track for supporting the housing 20. The interface between the housing 20 and base 30 are rollers 40 described in the previous reference to FIG. 3. The roller 40, its support 42 and axle 44 are shown. The standard motor which drives each roller 40 upon being energized is not shown. Each roller support 42 is attached to the bottom of the housing 20. The axle 44 extends through each support 42 and the housing 20. An L-shaped bracket 46 extends downward from each roller support and engages the protrusion 34 from the side of the lip/track 46 of the base 30 to lock the housing 20 to the base 30 while allowing the housing to continue to remain rotatable with respect to the base 30. The inner edge 38 of the base 30 maintains a snug fit with respect to the conduit 91 extending through the center of the base 30.

The reflectors 80, 82, 84 form a part of a reflector-sensor subassembly 60 which causes sunlight to be reflected through the skylight 10 and automatically tracked to maintain optimum reflection. Although a single reflector may be used, multiple reflectors enable more sunlight to be reflected. The multiple reflectors 80, 82, 84 used are aligned in a series which ranges from a shorter reflector 80 at the front of the housing 20 to a longest reflector 84 at the rear of the housing 20. The reflectors 80, 82, 84 are designed to reflect the maximum amount of sunlight while not prohibiting sunlight which is reflected from a succeeding reflector in the series as the reflectors are swung backwards to receive incident radiation when the sun is low on the horizon. The photovoltaic-sensor panel 61 contains photovoltaic cells and sensors (which are not seen in FIG. 4). The cells provide electrical energy for the motors which are controlled by the vertical and horizontal sensors on the panel 61. The sensors on the photovoltaic-sensor panel 61 initiate the energizing which cause the housing 20 to rotate on the base 30 to track the sun horizontally and which cause the reflectors 80, 82, 84 and panel 61 to pivot to track the sun vertically. In general, vertical sensors on the panel (described in greater detail below) energize a motor 70 which turns a shaft causing the panel 61 and reflectors 80, 82, 84 to swing backward as the sun rises from and sets on the horizon, optimizing the amount of sunlight which impinges the front of each reflector 80, 82, 84. The reflectors 80, 82, 84 are positioned at an angle that causes incident radiation to reflect downward along the light conduit. Horizontal sensors energize the motor or motors of the rollers 40 to position the opening of the housing 20 to receive maximum impinging sunlight as the sun travels from east to west.

Ultraviolet radiation 52 is filtered from sunlight by the lens 50. Remaining light radiation 54, 56 is reflected toward the light conduit subassembly 90. The top lens 92 of the light conduit subassembly 90 is infrared-deflecting and prevents infrared electromagnetic radiation from propagating through the conduit 91. Infrared electromagnetic radiation is deflected into the chamber of the housing 20. A second, or bottom, lens 94 in the light conduit subassembly 90 creates a dead-air space 96 between the top (92) and bottom (94) lenses. The dead air-space 96 prohibits heat energy from passing from the chamber of the housing 20 into the space lighted by the skylight 10. The light energy 54 which passes through the entire conduit subassembly 90 is dispersed by a light diffuser 98 at the end of the subassembly 90.

Figure 5:
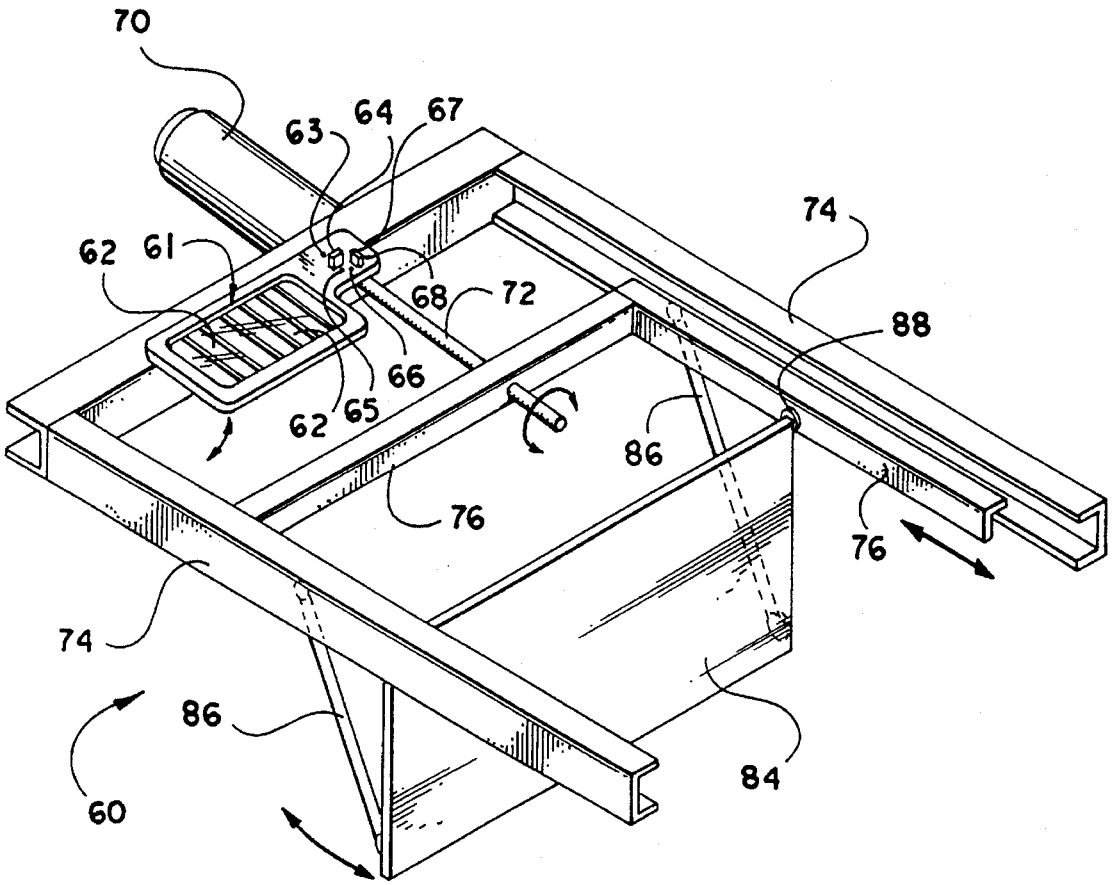
FIG. 5 is an isometric illustration of the reflector-sensor subassembly of the invention of FIG. 1.

Referring now to FIG. 4 and FIG. 5 simultaneously, the operation of the sensors 63, 64, 65, 66, 67, 68 and reflectors 80, 82, 84 will now be described in more detail. The photovoltaic panel 61 and reflectors 80, 82, 84 pivot about parallel horizontal axes. The panel 61 is moved by the action of a motor 70 which turns clockwise or counterclockwise while also turning a threaded shaft clockwise or counterclockwise. The photovoltaic cells 62 generate electrical energy sufficient to energize the motor 70, for example, about 1.5 volts dc. By conventional mechanical linkage, clockwise and counterclockwise rotation of the shaft 72 causes the panel 61 to pivot clockwise and counterclockwise, respectively, that is, downwardly or upwardly, respectively. The vertical sensor arrangement 63, 64, 65 together with a simple logic circuit (discussed in greater detail below) controls the energization and rotational direction of the motor 70. In general, the vertical sensor arrangement 63, 64, 65 reacts to movement of the sun to achieve and maintain a steady-state off condition when the surface of the panel 61 is essentially perpendicular to solar radiation (discussed in greater detail below). When the sun changes position, the sensor 63, 64, 65 and logic circuitry causes the motor 70 to turn until the perpendicular, steady-state alignment with the sun is again achieved. The optimum position for the reflectors 80, 82, 84 is that which causes reflected light rays 54 to project downward through the light conduit 91. There is a relationship between the alignment that the panel 61 must attain with respect to solar radiation 54 and the alignment which the reflectors 80, 82, 84 must attain with respect to solar radiation 54. As will be explained in greater detail below, in general, the angular rotation of the reflectors 80, 82, 84 must be twice that of the panel 61. This is easily achieved by using conventional mechanical connections to cause the shaft 72 to move the reflectors 80, 82, 84 at twice the angular rate that the panel 61 is moved. A stationary rack 74 is attached to the housing 20. Hinges 86 connect the freely-swinging portions of the respective reflectors 80, 82, 84 to the stationary rack. The reflectors 80, 82, 84 are pivotally connected to a movable rack 76 a pivot point 88.

The moveable rack 76 slides within the stationary rack 74. The threaded shaft 72 which drives the panel 61 also causes the moveable rack 76 to translate within the stationary rack 74. The mechanical connection required is a threaded connection at the joinder of the threaded shaft 72 and the moveable rack 74 which causes the moveable rack 74 move a distance which in turn causes the reflectors 80, 82, 84 to pivot about point 88 at an angular rate twice that of the panel 61. Clockwise-counterclockwise rotation of the shaft 72 cause respective to and fro movement of the moveable rack 74 which in turn causes respective clockwise-counterclockwise movement of the reflectors 80, 82, 84.

Figures 6, 7, 8, 9:
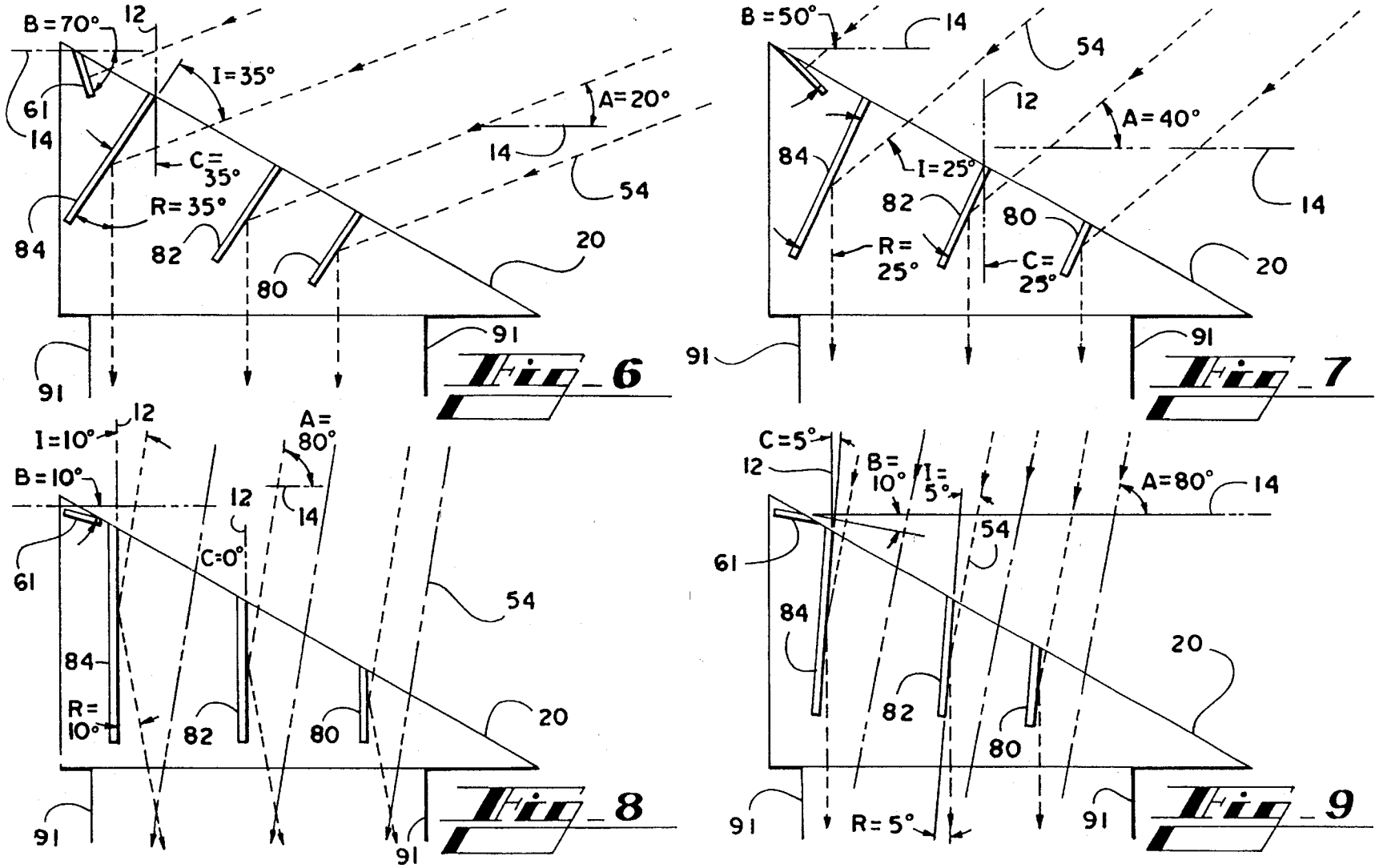
FIG. 6 is a schematic illustration of the operation of the invention of FIG. 1, illustrating impinging sunlight striking the skylight at an angle of about 20 degrees with respect to the horizon.
FIG. 7 is a schematic illustration of the operation of the invention of FIG. 1, illustrating impinging sunlight striking the skylight at an angle of about 40 degrees with respect to the horizon.
FIG. 8 is a schematic illustration of the operation of the invention of FIG. 1, illustrating impinging sunlight striking the skylight at an angle of about 80 degrees with respect to the horizon.
FIG. 9 is a schematic illustration of the operation of the invention of FIG. 1, also illustrating impinging sunlight striking the skylight at an angle of about 80 degrees with respect to the horizon.

Referring now also to FIGS. 6, 7, 8, and 9, the relationship between the movement of the panel 61 and reflectors 80, 82, 84 with respect to the movement of the sun will now be described. FIGS. 6, 7, 8, and 9 are schematic diagrams illustrating the desired alignment and position of the photovoltaic panel 61 and reflectors 80, 82, 84 during various positions of the sun. To aid in the understanding of this portion of the description, vertical reference lines 12 and horizontal reference lines 14 are used. Throughout FIGS. 6 through 9, impinging sunlight (solar radiation) 54 is shown irradiating the housing 20 of the skylight 10 from various angles with respect to the horizon. The angle of sunlight 54 with respect to the horizon and the horizontal surface upon which the skylight rests is denoted by the letter "A." The surface of the panel 61 is maintained in perpendicular alignment with impinging sunlight 54. The letter "B" is used to indicate the angular position of the panel 61 with respect to a horizontal reference plane and the horizontal reference line 14. The letter "C" denotes the angular position of the reflectors 80, 82, 84 with respect to a vertical reference line 12. In general, angle B will be equal to 90 degrees minus angle A, and angle C will be equal to ½ of angle B. The angle of incidence which sunlight 54 makes with the reflectors placed in an appropriate position to direct reflected light vertically downward is denoted by the letter "I." The angle of reflection is denoted by the letter "R." When the objective of vertically-downward projected light is achieved, C=R, and, as always, R=I. Thus, at optimum alignment, B=90−A, C=½ B, and C= I=R. Now, examples will be described. If the sun was directly overhead with radiation directed exactly perpendicular to the earth's surface (angle A= 90 degrees), the desired position for panel 61 would be exactly horizontal (angle B=0 degrees) and the desired position for reflectors 80, 82, 84 would be exactly vertical (angle C=0 degrees) allowing sunlight to pass directly to the light conduit 91 without being reflected. In this instance angle C is ½ of angle B, namely, 0 degrees. Referring now particularly to FIG. 6, the instance is illustrated when the sun is low on the horizon, either during sunrise or sunset. The angle A of 20 degrees is used for this illustration. When A=20 degrees, angle B=70 degrees, and angles C, I, and R=35 degrees. Referring now to FIG. 7, therein is schematically illustrated the position of the sun at an angle of 40 degrees, about midway through its ascent or descent. When A=40 degrees, angle B=50 degrees, and angles C, I, and R=25 degrees. Referring now to FIG. 8, therein is schematically illustrated the position of the sun at an angle of 80 degrees, at about its zenith. FIGS. 8 and 9 illustrate alternate methods of propagating sunlight when the sun is at its zenith. In FIG. 8, the reflectors 80, 82, 84 are made to hang loosely (C=0 degrees). In this manner, much sunlight would be substantially directed along the light conduit 91 without being reflected. In FIG. 9, the reflectors 80, 82, 84 are shown positioned at the minuscule angle C of 5 degrees. When A=80 degrees, angle B=10 degrees, and angles C, I, and R= 5 degrees. FIGS. 8 and 9 are shown as alternatives to one another because it may be easier to simply let the reflectors hang lose vertically when the sun is at its zenith unless the skylight 10 is constructed at very close tolerances.

Figure 10:
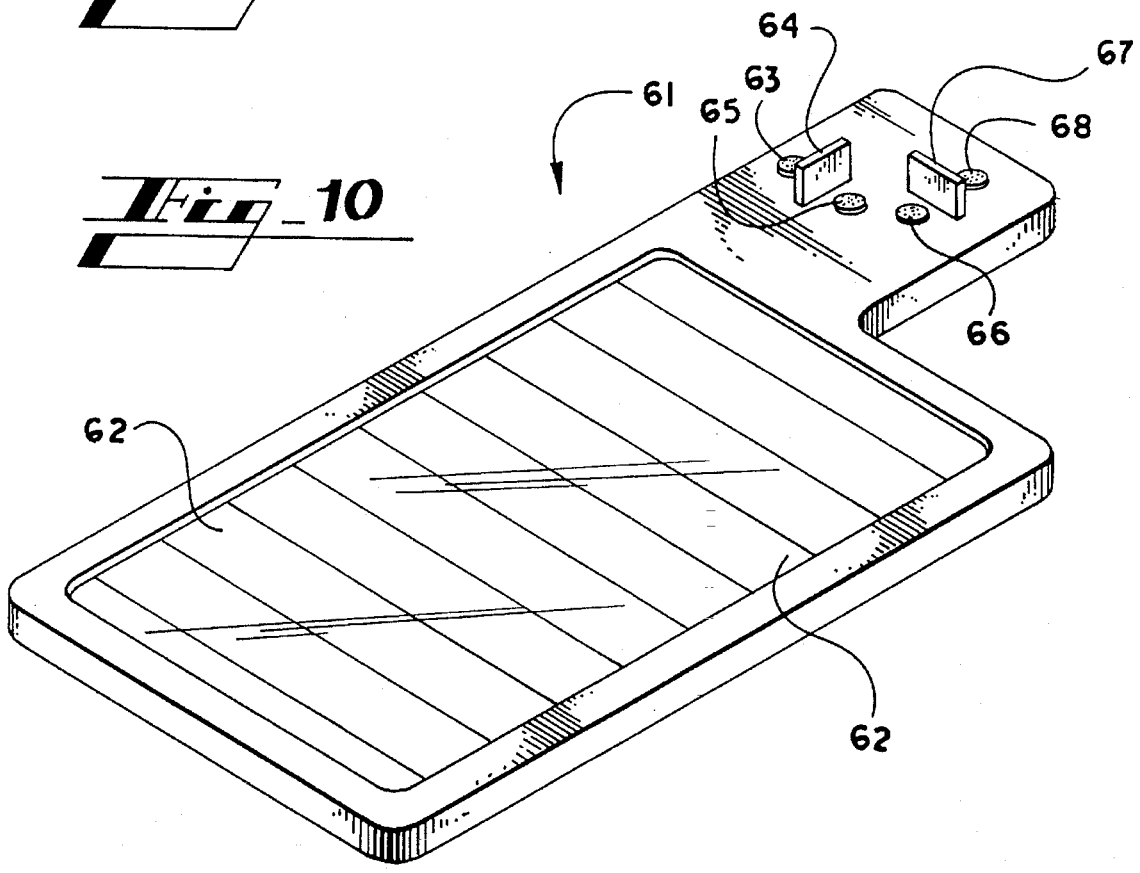
FIG. 10 is an isometric illustration of the photovoltaic-sensor panel of the reflector-sensor subassembly of the invention of FIG. 1.
Figure 11:
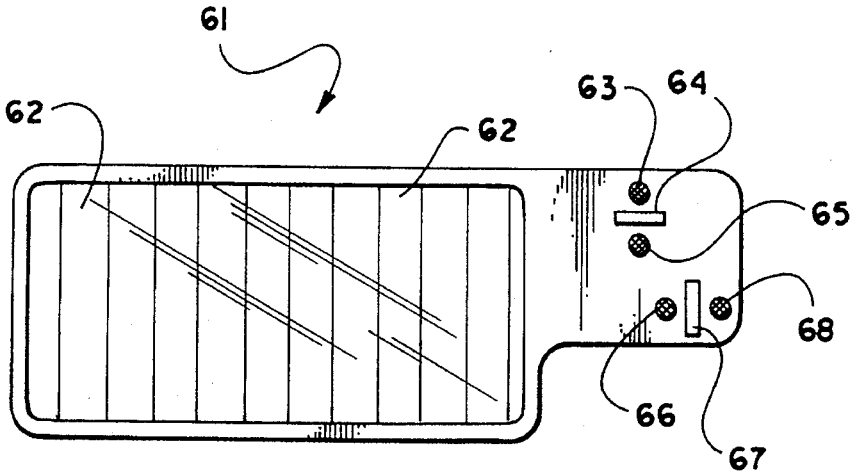
FIG. 11 is top plan illustration of the photovoltaic-sensor panel of the reflector-sensor subassembly of the invention of FIG. 1.

Referring now simultaneously to FIG. 10 and FIG. 11, the operation of the sensor arrangements will be described. As previously mentioned, the photovoltaic cell-sensor panel 61 contains sensors which combine with logic circuitry to cause motors driving the rollers 40 and the motor 70 driving the panel 61 and reflectors 80, 82, 84 to be energized. Combined sensor-logic circuitry seeks to attain and maintain an equilibrium condition where the same intensity of sunlight impinges each of the sensor of the respective pairs of sensors in the vertical and horizontal sensor arrangements. A vertical sensor arrangement 63, 64, 65 works in conjunction with a logic circuit to cause the panel-reflector motor 70 to be energized. A horizontal sensor arrangement 66, 67, 68 works in conjunction with a logic circuit to cause the motors driving the rollers 40 to be energized. Each sensor arrangement consists of two sensors which react to the absence and presence of sunlight 63 and 65, 66 and 68 separated by a partition 64, 67, respectively. The motors energized by each arrangement remain un-energized when both sensors receive the same amount of sunlight. As the sun moves, sunlight no longer perpendicularly impinges the panel 61. This movement of the sun causes at least one of the partitions 64, 67 to block sunlight to one of the sensors 63, 65, 66, 68, respectively. For example, as the sun rises the partition will eventually prohibit sunlight from impinging the lower vertical sensor 65. The logic circuitry causes the motor 70 to energize and rotate to pivot the panel 61 upwardly to a position perpendicular with the impinging sunlight. As previously described above, when the motor causes movement of the panel 61, movement of the reflectors 80, 82, 84 in the same direction as the panel 61 also occurs. The resting position of the panel 61 surface is perpendicular to the sun rays and the resting position of the reflectors 80, 82, 84 is an angle which causes sunlight to be reflected vertically downward into the light conduit 91. Similarly, when the sun moves from east to west, the partition 67 of the horizontal sensor arrangement will block light to one of the horizontal sensors 66, 68. As the rollers are energized to seek equilibrium between the sensors 66, 68, the housing 20 and its front opening is likewise placed in optimum impinging position with the sun.

As should be apparent from the foregoing specification, the invention is susceptible of being modified with various alterations and modifications which may differ from those which have been described in the preceding specification and description. Accordingly, the following claims are intended to cover all alterations and modifications which do not depart from the spirit and scope of the invention.

What is claimed is:

1. A skylight comprising:

a housing defining a first opening for receiving sunlight;

a base, defining a second opening for transmission of sunlight, and having an annular lip for mounting upon a building structure so that sunlight may be directed downwardly through said second opening into a structure to be lighted;

roller mechanism for communicating with said housing and said annular lip, and for rotatably supporting said housing with respect to said base;

a plurality of reflectors adjustably mounted within said housing for directing sunlight from said first opening substantially vertically downward through said second opening; and means for automatically adjusting alignment of said first opening with respect to sunlight and the angle of reflection between said reflectors and sunlight to optimize a quantity of sunlight impinging said reflectors.

2. A skylight comprising:

a housing having an open bottom and defining a first opening for receiving sunlight;

a base, defining a second opening for transmission of sunlight, and having an annular lip roller mechanism for communicating with said housing and said annular lip, and for rotatably supporting said housing with respect to said base with said open bottom of said housing aligned over said second opening;

means for rotating said housing with respect to said base;

first control means having first sensing means for detecting when said first opening is not aligned with received sunlight so that a maximum quantity of the received sunlight generally impinges said first opening for energizing said means for rotating said housing with respect to said base so as to generally maintain impingement of the maximum quantity of sunlight upon said first opening;

at least one reflector having a reflecting surface, pivotably connected within said housing proximate said first opening; and second control means having second sensing means for detecting when said at least one reflector is not aligned so as to receive and reflect through said second opening a maximum quantity of impinging sunlight for causing said at least one reflector to pivot so as to generally maintain impingement of the maximum quantity of sunlight upon said reflecting surface.

3. The invention of claim 2, said second control means comprising a panel pivotably connected within said housing proximate said first opening parallel to said at least one reflector;

third means for sensing sunlight and fourth means for sensing sunlight attached to said panel in vertical linear alignment separated by a second partition;

means for being energized to pivot said panel;

second electronic circuitry means for energizing said means for being energized to pivot said panel until said third said fourth means for sensing sunlight detect equal quantities of impinging sunlight;

means connecting said means pivoting said panel and said at least one reflector so that said at least one reflector pivots simultaneously with said panel in a proportionate relationship defined by the equations $$B=90 \text{ degrees}-A$$

and $$C=\tfrac{1}{2} B, \text{ where}$$

A equals a first angle which the sun forms with respect to a horizontal reference plane, B equals a second angle which a top surface of said panel forms with respect to a horizontal reference plane, and C equals a third angle which said reflecting surface of at least one reflector forms with a vertical reference plane.

4. The invention of claim 3, said first control means comprising first means for sensing sunlight and second means for sensing sunlight in horizontal linear alignment mounted upon said panel separated by a first partition; and first electronic circuitry means which energizes said means for rotating said housing with respect to said base until said first and second means for sensing sunlight detect equal quantities of impinging sunlight.

5. The invention of claim 4, further comprising at least one photovoltaic cell mounted upon said panel for proving electrical energy for said first control means for energizing said means for rotating said housing with respect to said base and for said means for being energized to pivot said panel.

6. The invention of claim 4, further comprising at least one photovoltaic cell mounted upon said panel for providing electrical energy for said means for rotating said housing with respect to said base, for said first control means for energizing said means for rotating said housing with respect to said base, for said means for being energized to pivot said panel, and for said second electronic circuitry means for energizing said means for being energized to pivot said panel.

7. The invention of claim 2, further comprising an air vent proximate an uppermost portion of said housing and air-intake means proximate a lowermost portion of said housing.

8. A skylight comprising:

a housing defining a first opening for receiving sunlight;

a base, defining a second opening for transmission of sunlight, adapted for supporting said housing;

means for rotating said housing with respect to said base;

first control means for energizing said means for rotating said housing with respect to said base so as to maximize a quantity of sunlight impinging said first opening;

at least one reflector having a reflecting surface, pivotably connected within said housing proximate said first opening; and second control means for causing said at least one reflector to pivot so as to maximize a quantity of sunlight impinging said reflecting surface having a panel pivotably connected within said housing proximate said first opening parallel to said at least one reflector;

third means for sensing sunlight and fourth means for sensing sunlight attached to said panel in vertical linear alignment separated by a second partition;

means for being energized to pivot said panel;

second electronic circuitry means for energizing said means for being energized to pivot said panel until said third said and fourth means for sensing sunlight detect equal quantities of impinging sunlight;

means connecting said means pivoting said panel and said at least one reflector so that said at least one reflector pivots simultaneously with said panel in a proportionate relationship defined by the equations $$B=90 \text{ degrees}-A$$

and $$C=\tfrac{1}{2} B, \text{ where}$$

A equals a first angle which the sun forms with respect to a horizontal reference plane, B equals a second angle which a top surface of said panel forms with respect to a horizontal reference plane, and C equals a third angle which said reflecting surface of at least one reflector forms with a vertical reference plane.

9. The invention of claim 8, said first control means comprising first means for sensing sunlight and second means for sensing sunlight in horizontal linear alignment mounted upon said panel separated by a first partition; and first electronic circuitry means which energizes said means for rotating said housing with respect to said base until said first and second means for sensing sunlight detect equal quantities of impinging sunlight.

10. The invention of claim 8, further comprising at least one photovoltaic cell mounted upon said panel for proving electrical energy for said first control means for energizing said means for rotating said housing with respect to said base and for said means for being energized to pivot said panel.

11. The invention of claim 9, further comprising at least one photovoltaic cell mounted upon said panel for providing electrical energy for said means for rotating said housing with respect to said base, for said first control means for energizing said means for rotating said housing with respect to said base, for said means for being energized to pivot said panel, and for said second electronic circuitry means for energizing said means for being energized to pivot said panel.

* * * * *